US007214883B2

(12) United States Patent
Leyendecker

(10) Patent No.: US 7,214,883 B2
(45) Date of Patent: May 8, 2007

(54) ELECTRICAL SIGNAL CABLE

(76) Inventor: Robert R. Leyendecker, 13020 Muldoon Dr., Austin, TX (US) 78729

( * ) Notice: Subject to any disclaimer, the term of this patent is extended or adjusted under 35 U.S.C. 154(b) by 0 days.

(21) Appl. No.: 11/410,452

(22) Filed: Apr. 25, 2006

(65) Prior Publication Data

US 2006/0237220 A1 Oct. 26, 2006

Related U.S. Application Data

(60) Provisional application No. 60/674,514, filed on Apr. 25, 2005.

(51) Int. Cl.
*H01B 7/00* (2006.01)

(52) U.S. Cl. ..... 174/110 R; 174/113 R

(58) Field of Classification Search ..... 174/110 R, 174/113 R, 113 C, 115, 116, 113 AS, 36
See application file for complete search history.

(56) References Cited

U.S. PATENT DOCUMENTS

| | | | | | |
|---|---|---|---|---|---|
| 479,525 | A * | 7/1892 | Gordan et al. | ..... | 174/28 |
| 571,760 | A * | 11/1896 | Perrine | ..... | 174/27 |
| 1,305,247 | A * | 6/1919 | Claremount et al. | ..... | 174/27 |
| 1,883,269 | A * | 10/1932 | Yonkers | ..... | 174/27 |
| 1,976,847 | A * | 10/1934 | Gordon et al. | ..... | 174/112 |
| 2,804,494 | A | 8/1957 | Fenton | | |
| 4,538,023 | A | 8/1985 | Brisson | | |
| 6,506,946 | B1 * | 1/2003 | Omori et al. | ..... | 568/807 |
| 6,639,152 | B2 * | 10/2003 | Glew et al. | ..... | 174/113 C |
| 6,812,408 | B2 * | 11/2004 | Clark et al. | ..... | 174/113 R |
| 2003/0106704 | A1 * | 6/2003 | Isley et al. | ..... | 174/113 R |
| 2003/0121695 | A1 * | 7/2003 | Wiebelhaus et al. | ..... | 174/116 |
| 2003/0217863 | A1 * | 11/2003 | Clark et al. | ..... | 174/113 R |
| 2004/0035603 | A1 * | 2/2004 | Clark et al. | ..... | 174/113 R |
| 2004/0118593 | A1 * | 6/2004 | Augustine et al. | ..... | 174/113 R |

* cited by examiner

*Primary Examiner*—William H. Mayo, III
(74) *Attorney, Agent, or Firm*—Daniel J. Chalker; Chalker Flores, LLP

(57) ABSTRACT

The present invention provides an electrical cable having two or more conductors, one or more multistrip insulators separating the two or more conductors from one another, and a protective cover formed around the two or more conductors and one or more multistrip insulators. The multistrip insulator may include one or more dielectric strips, one or more protective strips or a combination thereof. The present invention also provides a method for manufacturing an electrical cable by providing two or more conductors, separating the two or more conductors from one another using one or more multistrip insulators, and forming a protective cover around the two or more conductors and one or more multistrip insulators.

20 Claims, 3 Drawing Sheets

ELECTRICAL SIGNAL CABLE

PRIORITY CLAIM

This patent application is a non-provisional application of U.S. provisional patent application No. 60/674,514 filed on Apr. 25, 2005 and entitled "Conductors Insulated by Layers of Dielectric Material," which is hereby incorporated by reference in its entirety.

FIELD OF THE INVENTION

The present invention relates generally to the field of electrical cables and, more particularly, to electrical cables that transmit analog and/or digital signals.

BACKGROUND OF THE INVENTION

Electrical cables used to transfer audio, data and radio frequency signals are characterized by capacitive, inductive and resistive properties. Collectively, these properties establish the impedance of the electrical cable. One or more of these three properties can cause degradation of the original signal as it is transferred through the cable. It remains a great challenge in the electrical cable industry to minimize and/or carefully control each of these properties over a broad range of frequencies.

A well known technique to limit the inductive properties of an electrical cable involves the use of twisted pair construction. A conventional twisted pair cable design incorporates a pair of insulated conductors twisted around each other in a helical fashion. One advantage of twisted pair cable construction its reduced sensitivity to common mode magnetic interference. This reduced sensitivity occurs when one conductor is designated to carry a signal source current and the other conductor is designated to carry the signal return current. As the opposing currents travel through their respective twists, the opposing magnetic fields cancel each other at the interior of the cable. This cancellation, in effect, reduces the total loop area available within the circuit created by the electrical cable. With a smaller effective loop area achieved by adding additional twists, not only is the amount of magnetic energy stored and radiated reduced when compared to non-twisted electrical cable, but a smaller effective loop area also means the electrical cable is less sensitive to interfering magnetic fields. It is in this fashion that the effective inductance of a twisted pair cable is lower than the inductance of a non-twisted cable having the same overall length.

While twisted pair cabling has the inherent advantage of reduced magnetic fields, there are still improvements necessary to maintain complete minimization and/or control of the reactive portions of the cable impedance. Capacitance in a twisted pair design will depend on conductor length, cross sectional area, distance between conductors and the dielectric constant of the material used to insulate the conductors. As twists are added to a cable of fixed length, more conductor and insulating material will be required and capacitive coupling between conductors will increase as a result. So, while the total magnetic field will be reduced in a twisted pair design, a natural consequence is an increased amount of electric field energy stored in the dielectric medium, a phenomenon known as capacitive coupling, within the proximity of the two conductors.

For any required value of capacitance, an insulating material with a low dielectric constant separating source and return conductors allows these conductors to be arranged in closer spatial proximity to each other than the same conductors separated by a material with higher dielectric constant. Therefore, while the two dielectric materials can produce two different cables having the same measured value of capacitive coupling, the design utilizing the low dielectric constant insulator can result in a cable that has a lower measured inductance.

Various means of reducing capacitive coupling between the conductors of twisted pair cables are known to the art. Air is considered to be the best dielectric element for the purposes of reducing capacitive coupling. Air is also one of the most difficult elements to incorporate in an electrical cable design. Several techniques for incorporating air as a dielectric element have been disclosed. U.S. Pat. No. 1,305,247 discloses a strip of flexible insulating material separating conductors and maintained in an elastic and compressible condition. The insulating material can be formed with a continuous central hollow or air cavity. U.S. Pat. No. 2,804,494 discloses a twin lead twisted pair RF cable utilizing an elongated hollow tube with grooves formed in diametrically opposite sides of the tube and extending the length of the cable. Conductors are positioned in open spaces formed by the groove and rely on spacers to maintain the conductors in a constant spatial relationship.

When designing a cable to be used for high fidelity signaling an additional concern is the phenomenon of eddy currents known to cause a conductor to increase its resistance in proportion to the frequency being transmitted through the cable. Higher frequency signals will result in a current density that is concentrated at the surface of a conductor where these is less conductor area available. This effect is known in the art as skin effect. Skin effect contributes an additional measurable component of AC resistance to the over all impedance properties of the cable.

Litz wire techniques are well known in the electrical industry for reducing power losses due to eddy currents and the resulting skin effect. Power conversion circuits that utilize transformer or inductor windings make use of Litz wire properties to improve power efficiencies at high frequencies, typically less than 1 MHz. Among other techniques exploiting skin effect, U.S. Pat. No. 4,538,023 describes using conductors of various diameters with smaller diameter conductors surrounding larger diameter conductors as a means for adjusting the relative speed of high and low frequency components.

The twisted pair configurations which incorporate a continuous air channel suffer from several major limitations. In the previously mentioned patents, a continuous air cavity of significant cross sectional area with respect to the conductor diameter must be used to prevent deformation or collapse of the air cavity under the compression forces achieved during the twisting process and the compression forces exerted during normal bending necessary to conform the cable to environmental and installation conditions. An air gap that is larger than the minimum necessary to achieve a desired impedance results in a larger loop area with a consequentially larger inductance. In addition, these techniques require relatively complex and expensive manufacturing methods. Other known methods of providing substantially solid insulating strips between conductors do not incorporate any method for providing air as a substantial dielectric element. Moreover, these strip and air cavity dielectric techniques do not incorporate a specific means for reducing skin effect. Previously mentioned Litz wire designs intended to minimize skin effect do not address a specific means for incorporating air to reduce the capacitive effects between the signal source and return conductors of an electrical cable.

Accordingly it is desirable to have an electrical cable that overcomes these limitations and concerns.

SUMMARY OF THE INVENTION

The present invention provides an electrical cable with minimal values of resistance, capacitance and inductance. In addition, the present invention provides an economical means for incorporating air as a dielectric element in electrical cables. The present invention also provides an electrical cable with minimal susceptibility to skin effect. Furthermore, the present invention allows the transmission of low and high power electrical signals with minimal signal degradation.

More specifically, the present invention provides an electrical cable having two or more conductors, one or more multistrip insulators separating the two or more conductors from one another, and a protective cover formed around the two or more conductors and one or more multistrip insulators. The multistrip insulator may include one or more dielectric strips, one or more protective strips or a combination thereof.

In addition, the present invention provides an electrical cable having two or more conductors, one or more multistrip insulators separating the two or more conductors from one another and a protective cover formed around the two or more conductors and one or more multistrip insulators. Each multistrip insulator includes at least a dielectric strip disposed between a first protective strip and a second protective strip. The dielectric strip contains a set of air spaces distributed throughout the entirety of the dielectric strip.

The present invention also provides a method for manufacturing an electrical cable by providing two or more conductors, separating the two or more conductors from one another using one or more multistrip insulators, and forming a protective cover around the two or more conductors and one or more multistrip insulators. Each multistrip insulator includes at least a dielectric strip disposed between a first protective strip and a second protective strip. The dielectric strip has a set of air spaces distributed throughout the entirety of the dielectric strip.

The present invention is described in detail below with reference to the accompanying drawings.

BRIEF DESCRIPTION OF THE DRAWINGS

The above and further advantages of the invention may be better understood by referring to the following description in conjunction with the accompanying drawings, in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. The discussion herein relates primarily to an electrical signal cable, but it will be understood that the concepts of the present invention are applicable to any electrical signal medium where it is desirable to reduce resistance, capacitance and inductance.

The present invention provides an electrical cable with minimal values of resistance, capacitance and inductance. In addition, the present invention provides an economical means for incorporating air as a dielectric element in electrical cables. The present invention also provides an electrical cable with minimal susceptibility to skin effect. Furthermore, the present invention allows the transmission of low and high power electrical signals with minimal signal degradation. Note that the term "Conductor" is used herein to describe the part of the cable used to carry the electrical signal. The conductors described in the present invention may be constructed of multiple strands of insulated or uninsulated conducting material. The conductors may also be constructed of a single conducting strand. In any embodiment of the present invention the conductors and multistrip insulator may be either twisted together or remain untwisted.

Figure 1:
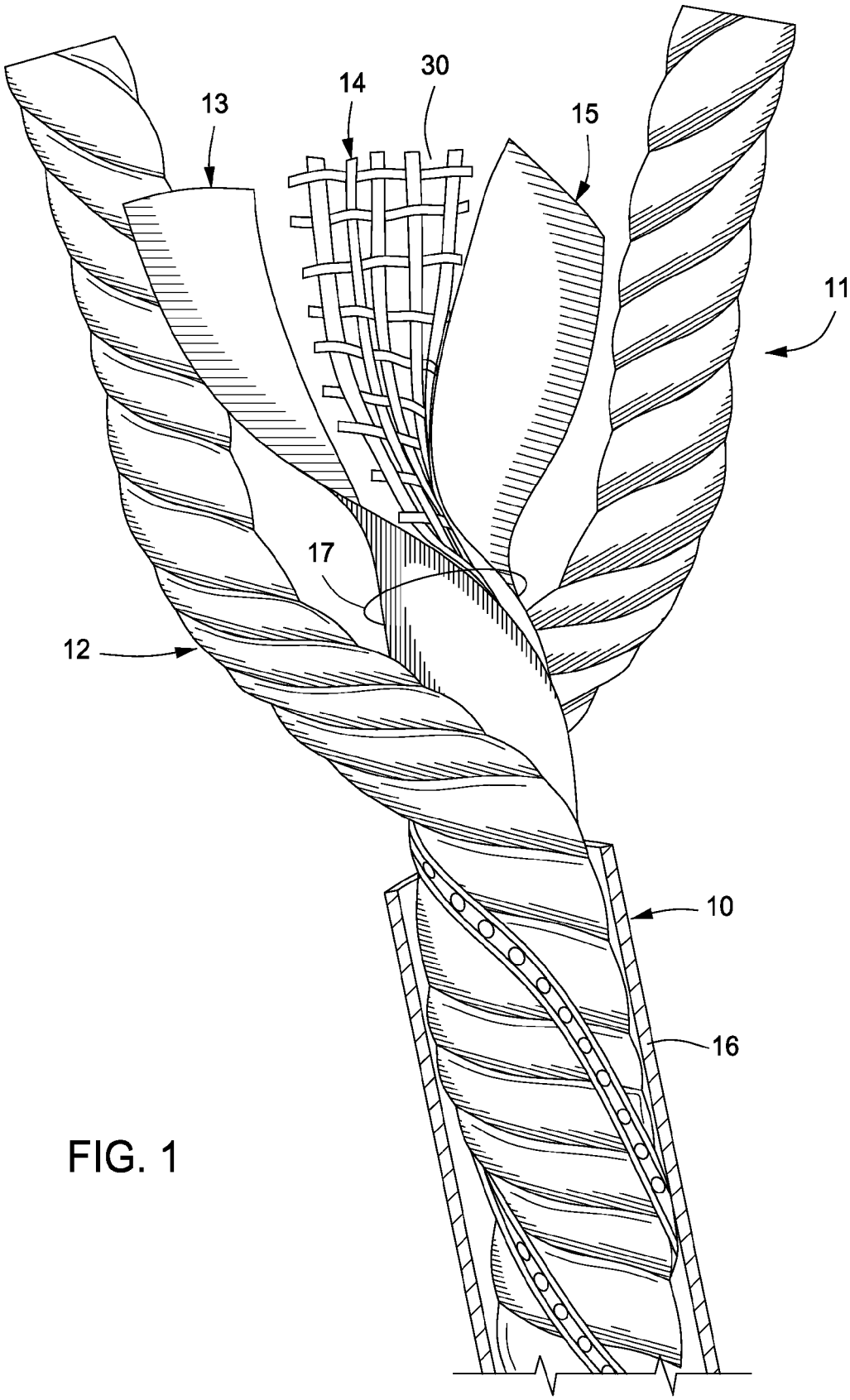
FIG. 1 is an elevation view of an electrical cable constructed in accordance with one embodiment of the present invention.
Figure 2:
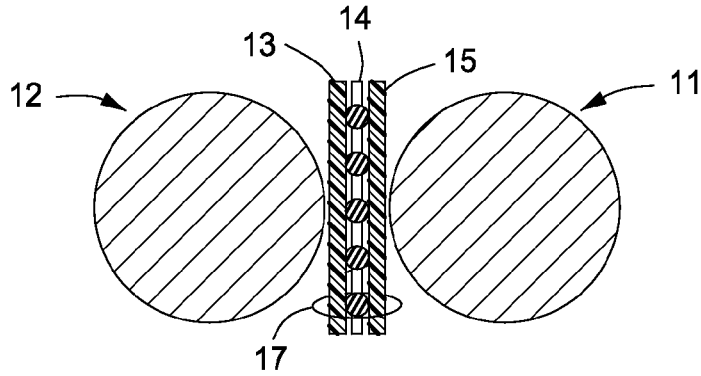
FIG. 2 is a greatly enlarged view taken along the lines 2—2 of FIG. 1.

Now referring to FIG. 1, an elevation view of an electrical cable 10 constructed in accordance with one embodiment of the present invention is shown. The electrical cable 10 includes two or more electrical conductors 11, 12. The two or more conductors 11, 12 can be an insulated conductor, an uninsulated conductor, a stranded conductor, a solid conductor or a combination thereof. Conductors 11 and 12 are separated by one or more multistrip insulators 17. The two or more electrical conductors 11, 12 and the one or more multistrip insulators 17 are encased in a protective cover 16. The multistrip insulator 17 may include one or more dielectric strips, one or more protective strips or a combination thereof (e.g., a first dielectric strip 14 and a first protective strip 13, etc.). As shown, the multistrip insulator 17 includes a first dielectric strip 14 disposed between a first protective strip 13 and a second protective strip 15. Protective strips 13, 15 are constructed from a material with low surface friction, such as a strip of polytetrafluoroethylene (PTFE). The dielectric strip 14 is formed from a material fabricated with a plurality of spaces for air 30 such as polypropylene or PTFE mesh. The multistrip insulator 17 maintains the structural integrity and dimensional stability of the spaces for air 30 enclosed within the dielectric strip 14 when the conductors 11, 12 and multistrip insulator 17 are flexed and/or twisted together. FIG. 2 further illustrates the interaction between the protective strips 13, 15, dielectric strip 14 and the conductors 11, 12. Likewise, FIG. 3 further clarifies the arrangement of protective strips 13, 15 and dielectric strip 14 in the formation of a multistrip insulator 17. Spaces for air 30 within dielectric strip 14 are enclosed by the strands 31 of the mesh material and the protective strips 13, 15.

The spaces for air 30 may be formed from apertures or indentations of varying dimensions and geometries. The use of a mesh material formed by orthogonally placed plastic strands may result in a plurality of air spaces uniformly distributed along the length of the cable with each space for air 30 forming an aperture having a rectangular geometry. The use of a perforated plastic strip may result in a plurality of air spaces 30 uniformly distributed along the length of the cable with each space for air forming an aperture with round geometry. Other possible aperture geometries for 30 include rhomboid, elliptical, triangular, square and random. Any combination of the various geometries may be incorporated in the dielectric strip 14.

Protective strips 13, 15 can be made from any suitable material. A partial list of example materials suitable for 13, 15 include polyvinylchloride (PVC), PTFE, polyethylene, FEP, polyethylene, nylon, Kapton to which may be added flexible ceramic fibers and/or flexible fiberglass strands. Dielectric strip 14 can be made from any suitable material constructed with a plurality of spaces for air such as braided, woven, meshed, screened or foamed strips. A partial list of example materials suitable for dielectric 14 include polyvinylchloride (PVC), PTFE, FEP, polyethylene, polypropylene, nylon, Kapton to which may be added flexible ceramic fibers and/or flexible fiberglass strands. Strips 13, 14, 15 may be made with any of these materials or any combination of them. As result, each dielectric strip or each protective strip may include a material (e.g., polyvinylchloride (PVC), polytetrafluoroethylene (PTFE), polyethylene, FEP, polyethylene, nylon, Kapton, set of flexible ceramic fibers, set of flexible fiberglass strands, glass tape, glass fabric, plastic tape, plastic fabric, plastic braid or a combination thereof) that is braided, woven, meshed, screened, perforated, foamed or a combination thereof. In certain cases it may be desirable to apply an adhesive to either the protective strips or dielectric strips to help secure the various layers of the multistrip insulator 17.

Figure 3:
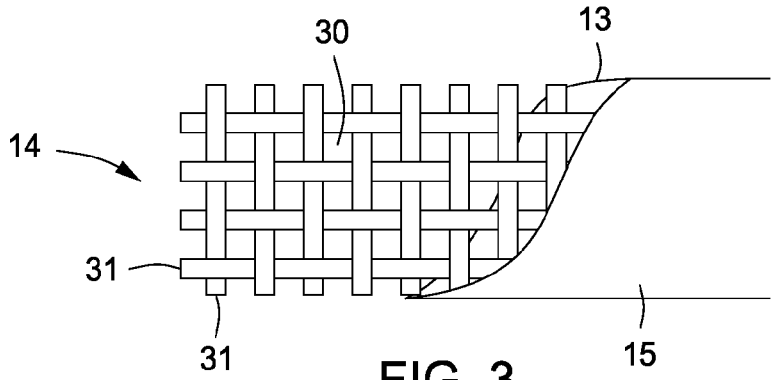
FIG. 3 is an elevation view of FIG. 2 with the protective dielectric layers broken away to disclose the dielectric strip having spaces for air in accordance with one embodiment of the present invention.
Figure 4:
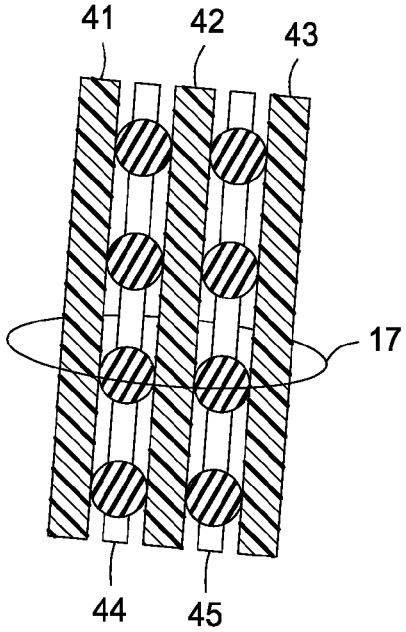
FIG. 4 is a cross sectional view of another embodiment of the present invention having a multistrip insulator having alternating layers of dielectric strips and protective strips.
Figure 5:
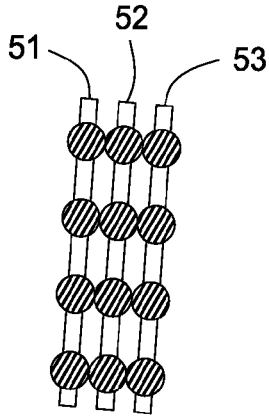
FIG. 5 is a cross sectional view of another embodiment of the present invention having several layers of dielectric strips forming a multistrip insulator.

FIGS. 1, 2 and 3 are provided for illustration purposes only and are not meant to be limitations of the present invention. For example, the multistrip insulator 17 can include any combination and number of protective layers and dielectric layers. FIGS. 4 and 5 illustrate alternate embodiments of the multistrip insulator 17. In FIG. 4, a first dielectric strip 44 is disposed between a first protective strip 41 and a second protective strip 42, and a second dielectric strip 45 is disposed between the second protective strip 42 and a third protective strip 43. It should be obvious to those skilled in the art that many modifications and adaptations to the multistrip insulator 17 will occur by varying the order and number of layers of dielectric material and/or protective strips and these modifications and adaptations are within the scope of the present invention. The use of a protective strip is not required for all possible embodiments claimed by this invention. For example, as shown in FIG. 5, alternate embodiments may be created by constructing a multistrip insulator 17 by using one or more layers comprised of dielectric strip material 51, 52, 53.

In keeping with one of the principal objects of the present invention, conductors 11, 12 are comprised of separately insulated conducting strands woven together such that each of said conducting strands tends to take all possible positions within the cross-section of the entire conductor. To those skilled in the art, this construction is known as Litz wire construction. Litz wire construction has the advantage of reducing signal loss at higher frequencies due to the phenomenon of skin effect. The conductors 11, 12 described in the present invention may be constructed of multiple strands of insulated or uninsulated conducting material. In the preferred embodiment shown in FIG. 1, the conductors 11, 12 and multistrip insulator 17 are twisted together.

Figure 6:
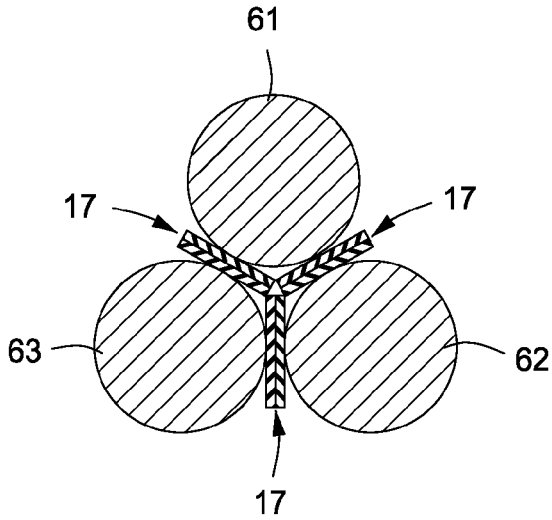
FIG. 6 is a cross-sectional view of another embodiment of the present invention having three conductors.
Figure 7:
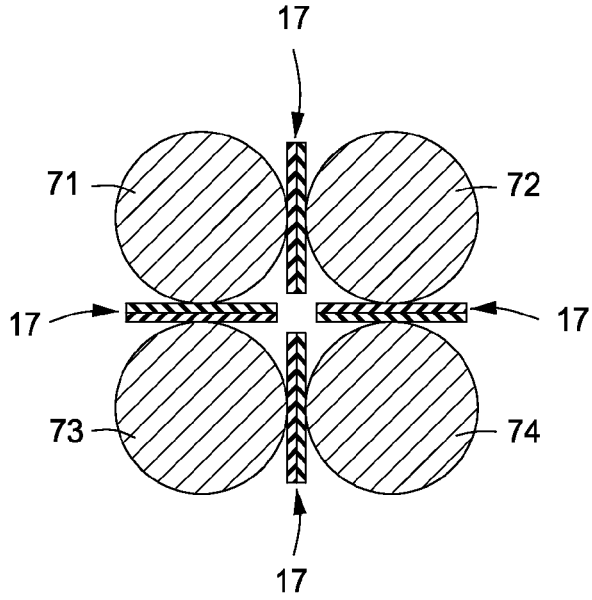
FIG. 7 is a cross-sectional view of another embodiment of the present invention having four conductors.

FIGS. 6 and 7 also illustrate additional alternate embodiments of the present invention. In these figures, it can be seen that cables comprising more than two conductors can incorporated within the scope of the present invention. FIG. 6 illustrates how the present invention can be applied to the construction of an electrical cable with three conductors 61, 62, 63. FIG. 7 illustrates how the present invention can be applied to the construction of an electrical cable with four conductors 71, 72, 73, 74.

Figure 8:
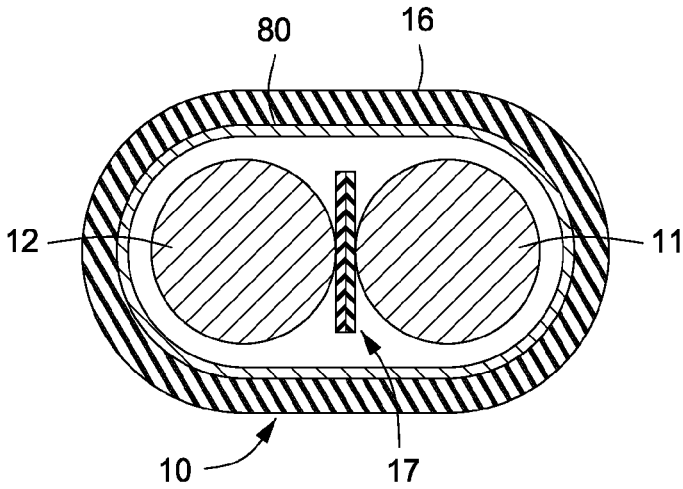
FIG. 8 is a cross-sectional view of another embodiment of the present invention having a shielding element.

In yet another embodiment, FIG. 8 illustrates a shielding element 80 for the electrical cable 10 surrounding conductors 11, 12 and multistrip insulator 17 and disposed inside the protective jacket 16. The shielding element 80 may be manufactured of any material suitable for attenuating magnetic and/or electric fields such as metal foil, metal braid, metalized plastic foil or a combination thereof.

Protective cover 16 in the preferred embodiment is fabricated from heat shrinkable, clear tubing. Heat shrinkable tubing has the advantage of providing a constant compressive force securing the conductors 11, 12 firmly to the multistrip insulator 17. The compressive force provided by the heat shrink tubing maintains the overall dimensional stability of the electrical cable and as a result the cable impedance is uniform along the length of the electrical cable and the impedance specification will remain consistent over independent manufacturing runs. For ease of fabrication, the tubing may be applied as a contiguous series of short strips. Alternate embodiments of the present invention may utilize suitable extruded or pressure jacket methods for fabricating the protective cover 16.

The present invention also provides a method for manufacturing an electrical cable (10) by providing two or more conductors (11, 12), separating the two or more conductors (11, 12) from one another using one or more multistrip insulators (17), and forming a protective cover (16) around the two or more conductors (11, 12) and one or more multistrip insulators (17). Each multistrip insulator (17) includes at least a dielectric strip (14) disposed between a first protective strip (13) and a second protective strip (15). The dielectric strip (14) includes a set of air spaces (30) distributed throughout the entirety of the dielectric strip (14). The method can also include the steps of twisting the two or more conductors (11, 12) and the one or more multistrip insulator (17), and/or forming one or more shielding elements (80) around the two or more conductors (11, 12) and the one or more multistrip insulators (17).

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An electrical cable, comprising:

two or more conductors;

one or more multistrip insulators separating the two or more conductors from one another, each multistrip insulator comprising at least one dielectric strip having a set of air spaces distributed throughout the entirety of the dielectric strip; and a protective cover formed around the two or more conductors and one or more multistrip insulators.

2. The electrical cable as recited in claim 1, wherein the multistrip insulator further comprises, one or more protective strips.

3. The electrical cable as claimed in claim 2, wherein:

each dielectric strip or each protective strip comprises a material that is braided, woven, meshed, screened, perforated, foamed or a combination thereof; and the material comprises a polyvinylchloride (PVC), a polytetrafluoroethylene (PTFE), a polyethylene, a FEP, a polyethylene, a nylon, a Kapton, a set of flexible ceramic fibers, a set of flexible fiberglass strands, a glass tape, a glass fabric, a plastic tape, a plastic fabric, a plastic braid or a combination thereof.

4. The electrical cable as recited in claim 2, wherein the one or more protective strips prevent deformation of the one or more dielectric strips and the two or more conductors.

5. The electrical cable as recited in claim 1, wherein the multistrip insulator comprises:

a first dielectric strip disposed between a first protective strip and a second protective strip, wherein the first dielectric strip has a set of air spaces distributed throughout the entirety of the first dielectric strip.

6. The electrical cable as recited in claim 5, wherein the multistrip insulator further comprises a second dielectric strip disposed between the second protective strip and a third protective strip, wherein the second dielectric strip further comprises a set of air spaces distributed throughout the entirety of the second dielectric strip.

7. The electrical cable as claimed in claim 1, wherein each air space comprises an aperture, an indention or combination thereof.

8. The electrical cable as recited in claim 1, wherein the air spaces comprise a uniform geometry, a random geometry or a combination thereof.

9. The electrical cable as recited in claim 1, wherein the multistrip insulator and the two or more conductors are twisted together.

10. The electrical cable as recited in claim 1, wherein at least one of the two or more conductors comprises an insulated conductor, an uninsulated conductor, a stranded conductor, a solid conductor or a combination thereof.

11. The electrical cable as recited in claim 1, wherein at least one of the two or more conductors comprises a set of separately insulated conducting strands woven together such that each of the conducting strands tends to take all possible positions within a cross-section of an entire length of the conductors.

12. The electrical cable as claimed in 1, wherein an adhesive is applied to one or more strips of the one or more multistrip insulators.

13. The electrical cable as claimed in 1, wherein the protective cover comprises one or more sections of heat shrink tubing selected to compress the two or more conductors and the one or more multistrip insulators together.

14. The electrical cable as claimed in 1, farther comprising one or more shielding elements formed around the two or more conductors and the one or more multistrip insulators.

15. The electrical cable as recited in claim 14, wherein the one or more shielding elements comprise a metal foil, a metal braid, a metalized plastic or a combination thereof.

16. The electrical cable as recited in claim 1, and further comprising one or more shielding elements disposed within the protective cover.

17. An electrical cable, comprising:

two or more conductors;

one or more multistrip insulators separating the two or more conductors from one another, each multistrip insulator comprising at least a dielectric strip disposed between a first protective strip and a second protective strip, the dielectric strip having a set of air spaces distributed throughout the entirety of the dielectric strip; and a protective cover formed around the two or more conductors and one or more multistrip insulators.

18. A method for manufacturing an electrical cable comprising the steps of:

providing two or more conductors;

separating the two or more conductors from one another using one or more multistrip insulators, each multistrip insulator comprising at least a dielectric strip disposed between a first protective strip and a second protective strip, the dielectric strip having a set of air spaces distributed throughout the entirety of the dielectric strip; and forming a protective cover around the two or more conductors and one or more multistrip insulators.

19. The method as recited in claim 18, further comprising the step of twisting the two or more conductors and the one or more multistrip insulators.

20. The method as recited in claim 18, farther comprising the step of forming one or more shielding elements around the two or more conductors and the one or more multistrip insulators.

* * * * *